US007654277B1

(12) United States Patent
Brewer et al.

(10) Patent No.: US 7,654,277 B1
(45) Date of Patent: Feb. 2, 2010

(54) PORTABLE SHADE

(76) Inventors: Don C. Brewer, 9750 E. River Rd. North, Olmsted Falls, OH (US) 44138; Nicole Brewer, 9750 E. River Rd. North, Olmsted Falls, OH (US) 44138

( * ) Notice: Subject to any disclaimer, the term of this patent is extended or adjusted under 35 U.S.C. 154(b) by 181 days.

(21) Appl. No.: 11/833,372

(22) Filed: Aug. 3, 2007

(51) Int. Cl.
*E04H 15/36* (2006.01)

(52) U.S. Cl. ..... 135/124; 135/118; 135/136; 135/906; 52/2.25; 52/86; 248/533

(58) Field of Classification Search ..... 135/121–124, 135/115, 118–119, 120.3, 136, 906; 52/2.25, 52/23, 83, 63, 156, 162, 164–165, 86; 248/156, 248/508, 530, 533; 43/16
See application file for complete search history.

(56) References Cited

U.S. PATENT DOCUMENTS 3,480,023 A * 11/1969 McConnell et al. ..... 135/125
3,855,643 A * 12/1974 Sanford et al. ..... 4/498
3,881,269 A * 5/1975 Timmons ..... 43/15
4,347,690 A * 9/1982 Wallace, Jr. ..... 52/93.1
4,404,980 A * 9/1983 Wade ..... 135/123
4,782,846 A * 11/1988 Ting ..... 135/120.3
4,815,736 A * 3/1989 Wright ..... 473/421
4,960,144 A * 10/1990 Wheatley et al. ..... 135/123
5,404,896 A * 4/1995 Howe ..... 135/125
5,588,630 A * 12/1996 Chen-Chao ..... 248/514
5,671,766 A * 9/1997 Williams ..... 135/121
6,112,756 A * 9/2000 Tseng ..... 135/123
6,470,901 B1 * 10/2002 Scherer ..... 135/136
6,502,593 B1 * 1/2003 Stafford ..... 135/115
6,684,555 B1 * 2/2004 Vela ..... 43/15
6,953,180 B1 * 10/2005 Ruvalcaba et al. ..... 248/530

* cited by examiner

*Primary Examiner*—Winnie Yip

(57) ABSTRACT

A portable shade. An illustrative embodiment of the portable shade includes a canopy; a plurality of generally elongated, curved, spaced-apart tent poles carried by the canopy; and a plurality of anchor units receiving the plurality of tent poles, respectively. Each of the anchor units comprises an anchor plate, a striker plate pivotally carried by the anchor plate and a pole receptacle pivotally carried by the striker plate and receiving a corresponding one of the tent poles.

4 Claims, 5 Drawing Sheets

PORTABLE SHADE

FIELD

The present disclosure relates to shades. More particularly, the present invention relates to a portable shade which is compact and lightweight and can be deployed and disassembled by one or two persons.

BACKGROUND

Tents are commonly used to shade persons from the sun during outdoor events. However, many conventional tents are cumbersome and time-consuming to set up and take down and may require several persons for the purpose. Therefore, a portable shade is needed which is compact, lightweight and can be deployed and disassembled by one or two persons.

SUMMARY

The present invention is generally directed to a portable shade. An illustrative embodiment of the portable shade includes a canopy; a plurality of generally elongated, curved, spaced-apart tent poles carried by the canopy; and a plurality of anchor units receiving the plurality of tent poles, respectively. Each of the anchor units comprises an anchor plate, a striker plate pivotally carried by the anchor plate and a pole receptacle pivotally carried by the striker plate and receiving a corresponding one of the tent poles.

BRIEF DESCRIPTION OF THE DRAWINGS

The disclosure will now be made, by way of example, with reference to the accompanying drawings, in which.

DETAILED DESCRIPTION

Figure 1:
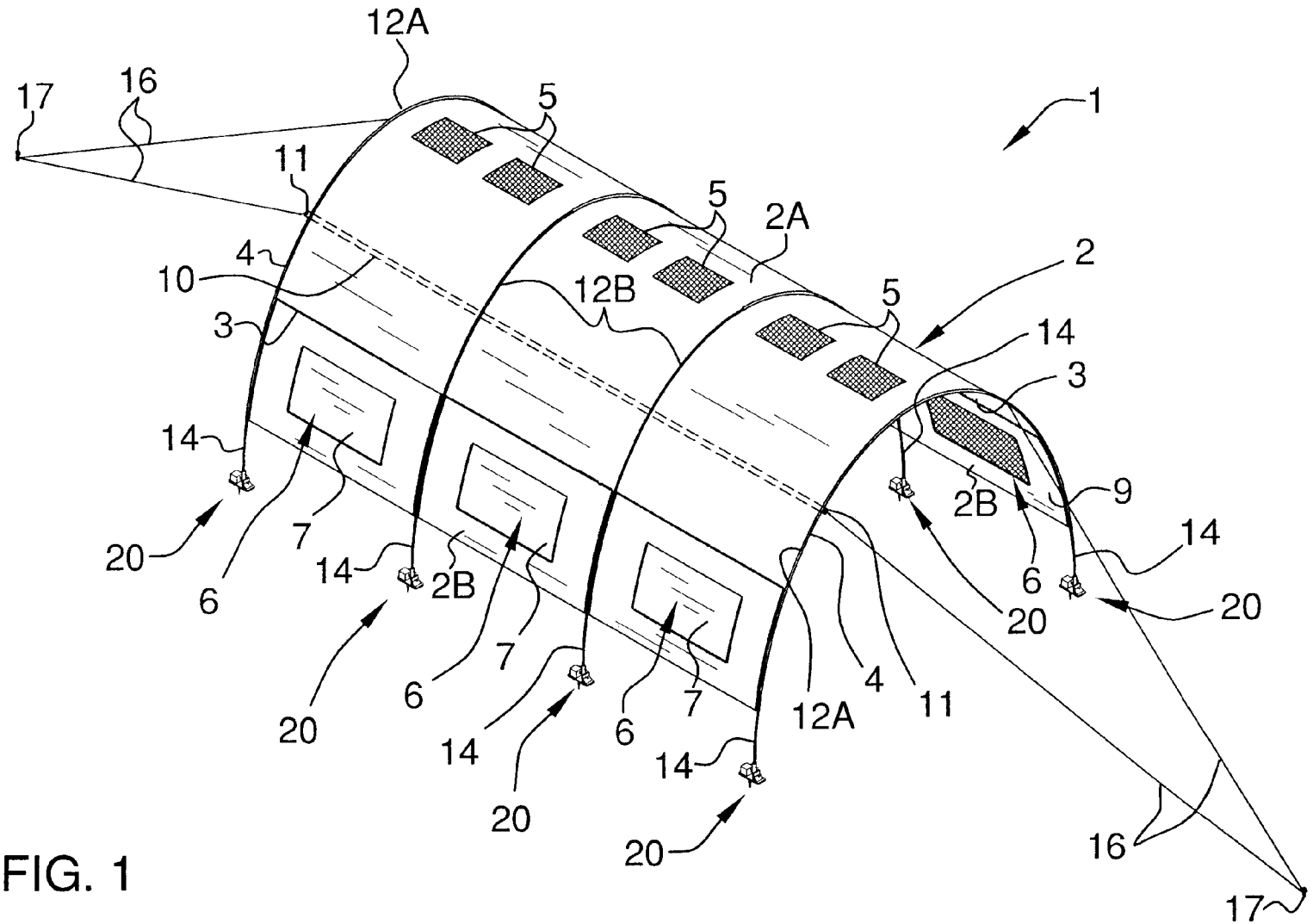
FIG. 1 is a front perspective view of an illustrative embodiment of the portable shade, deployed in a functional configuration.
Figure 2:
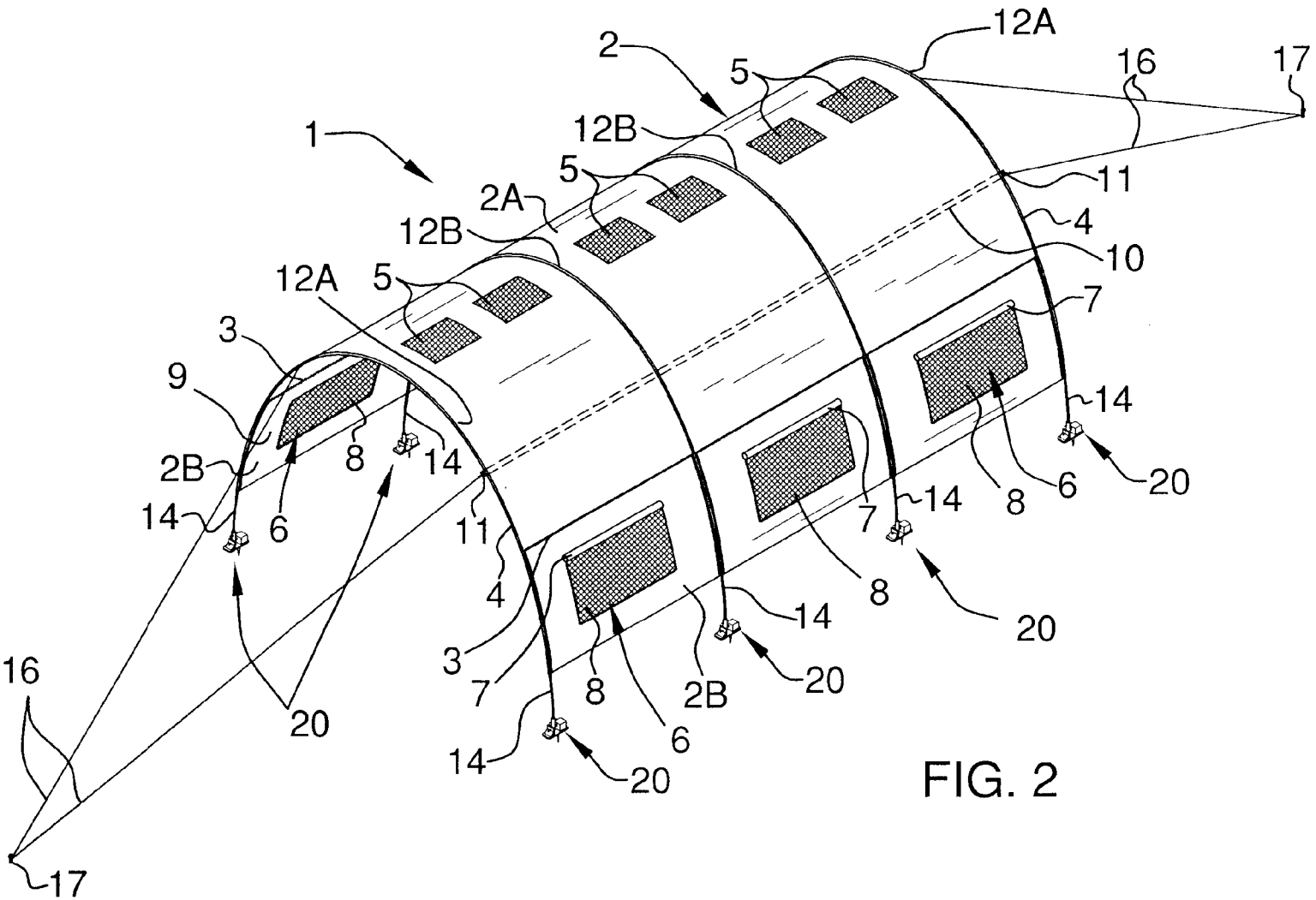
FIG. 2 is a rear perspective view of an illustrative embodiment of the portable shade, deployed in a functional configuration.

Referring to the drawings, an illustrative embodiment of the portable shade is generally indicated by reference numeral 1. The portable shade 1 includes a canopy 2 which may be any suitable flexible, durable, waterproof material such as vinyl or nylon, for example. As shown in FIGS. 1 and 2, the canopy 2 of the canopy 1 includes a main canopy section 2*a* having a generally elongated, rectangular shape. The main canopy section 2*a* has a pair of longitudinal edges 3 and a pair of transverse edges 4. In some embodiments of the canopy 1, a window canopy section 2*b* extends from each longitudinal edge 3 of the main canopy section 2*a*. In other embodiments of the portable shade 1*a* shown in FIG. 3, the canopy sections 2*b* are omitted from the longitudinal edges 3 of the main canopy section 2*a*. At least one vent panel 5 is typically provided in the main canopy section 2*a*.

As shown in FIGS. 1 and 2, at least one window 6 is provided in each window section 2*b* of the portable shade 1. As shown in FIG. 2, each window 6 typically includes a netted or meshed window screen 8. A solid window cover 7 is attached to the window section 2*b* and can be selectively extended over the window screen 8, as shown in FIG. 1.

Figure 5:
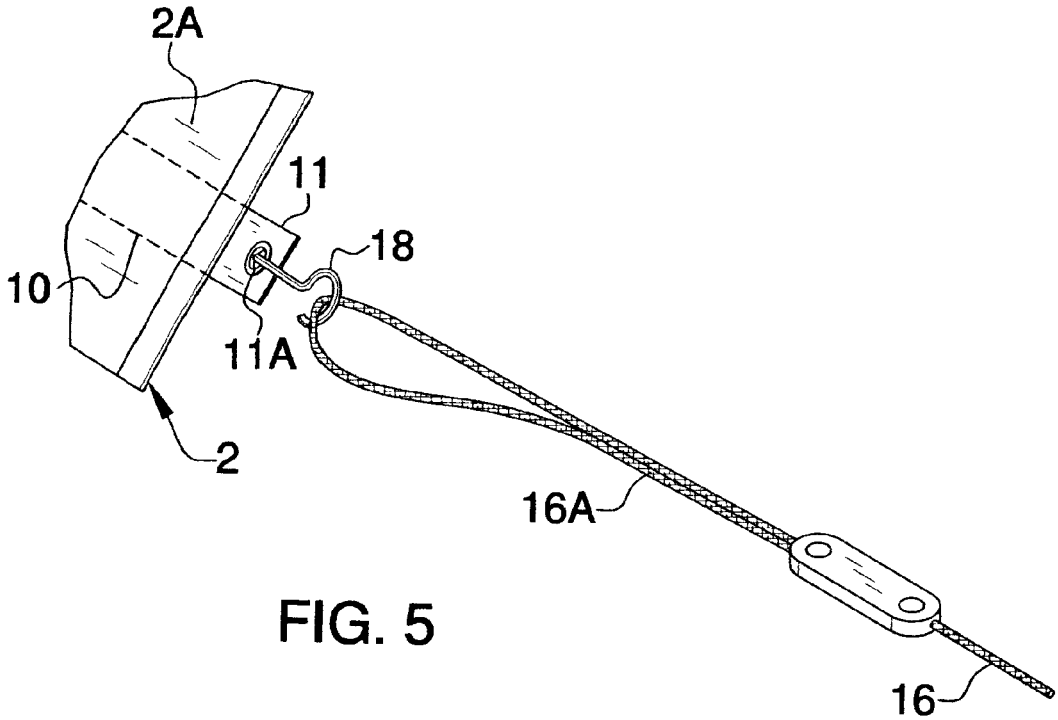
FIG. 5 is a perspective view illustrating an exemplary technique for attaching a tie-down cord to the tent canopy element of an illustrative embodiment of the portable shade.
Figure 6:
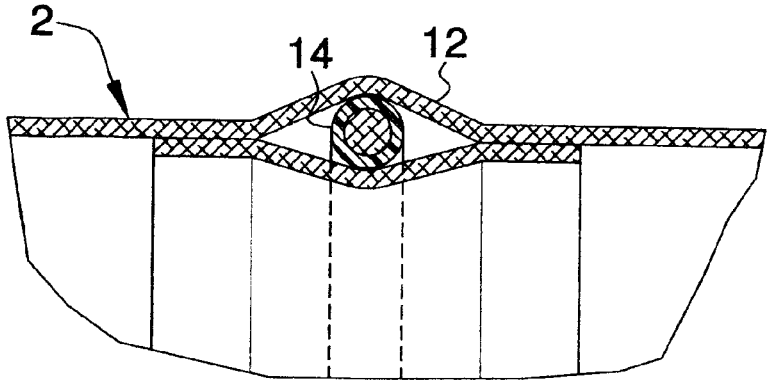
FIG. 6 is a cross-sectional view of a tent pole extending through a pole sleeve element of an illustrative embodiment of the portable shade.

At least one reinforcing strap 10 (shown in phantom) extends along the main canopy section 2*a*, generally adjacent and spaced-apart with respect to each longitudinal edge 3 of the main canopy section 2*a*. As shown in FIG. 5, a cord tab 11, having a cord opening 11*a*, extends from each end of each reinforcing strap 10, at each transverse edge 4 of the main canopy section 2*a*. An attachment hook 18 extends through the cord opening 11*a* of each cord tab 11. A cord loop 16*a* provided on one end of a tie-down cord 16 engages the attachment hook 18. A second end of the tie-down cord 16 is attached to a stake 17. In use of the portable shade 1, as will be hereinafter described, the stakes 17 are inserted in the ground (not shown) to deploy the portable shade 1 in the functional configuration shown in FIGS. 1 and 2.

Figure 3:
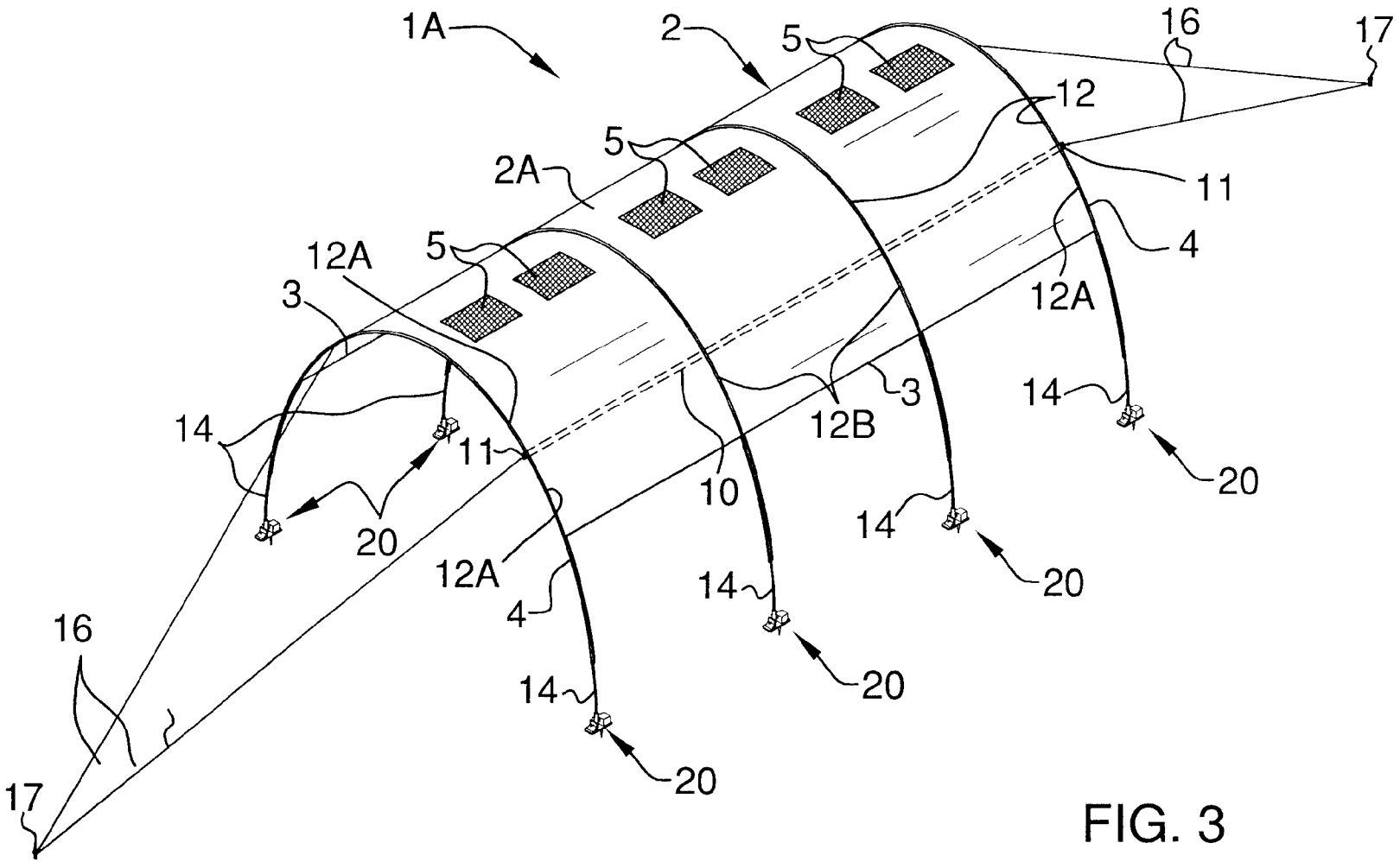
FIG. 3 is a front perspective view of an alternative illustrative embodiment of the portable shade.

Multiple, spaced-apart, transverse pole sleeves 12*a* are provided in the main canopy section 2*a* of the portable shade 1*a* shown in FIG. 3 and in both the main canopy section 2*a* and the window canopy sections 2*b* of the portable shade 1 shown in FIGS. 1 and 2. The pole sleeves 12 are oriented in generally parallel relationship with respect to the transverse edges 4 of the main canopy section 2*a*. A first, lateral pair of the pole sleeves 12*a* typically extends along the respective transverse edges 4 of the main canopy section 2*a* and a second, middle pair of the pole sleeves 12*b* extends between the lateral pair of pole sleeves 12*a*. Each pole sleeve 12 is adapted to receive a generally elongated, curved tent pole 14 which extends through each pole sleeve 12. The ends of each tent pole 14 protrude beyond the longitudinal edges 3 of the main canopy section 2*a* of the canopy 2 in the portable shade 1*a* shown in FIG. 3 and further beyond the longitudinal edge of each window canopy section 2*b* in the portable shade 1 shown in FIGS. 1 and 2.

Figure 4:
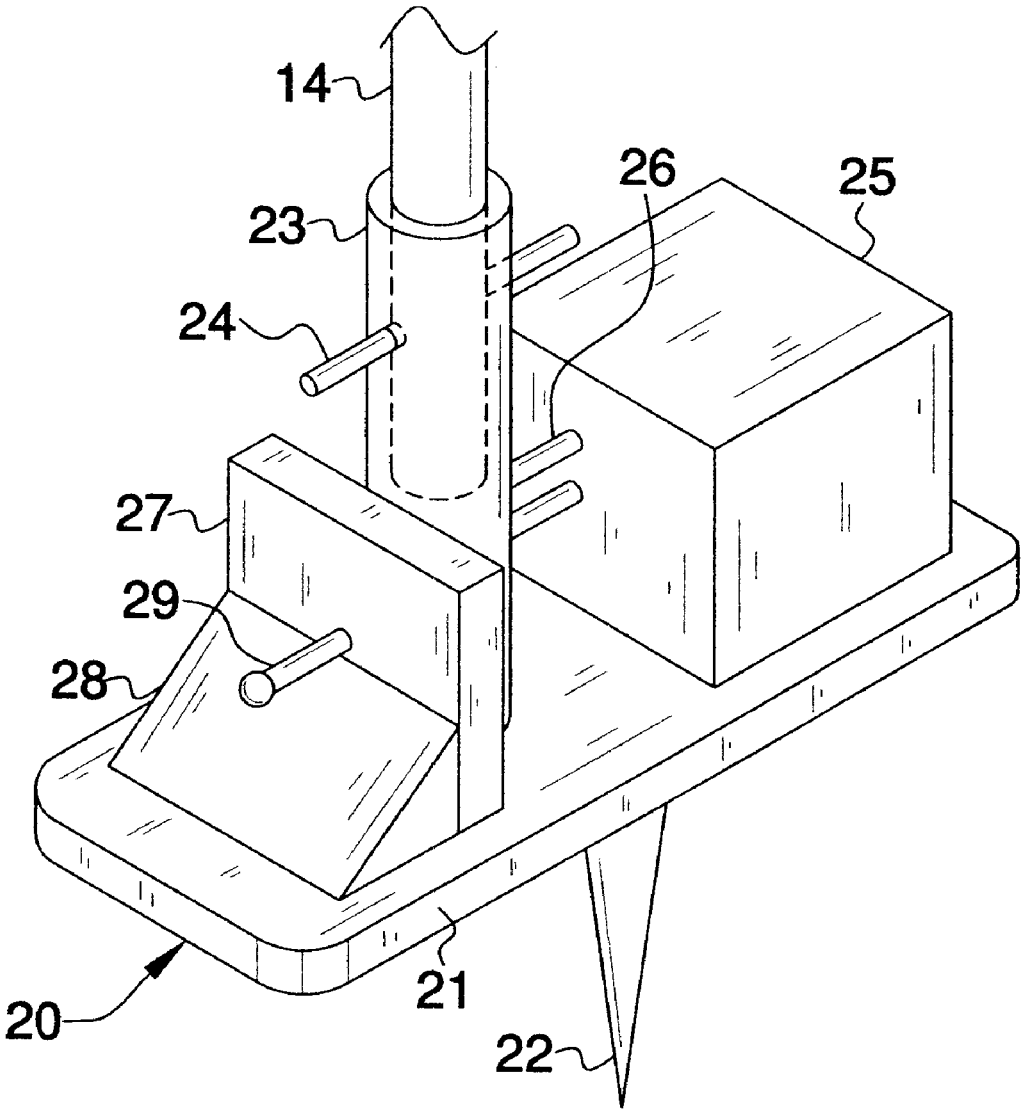
FIG. 4 is a perspective view of an illustrative anchor unit which is suitable for supporting an illustrative embodiment of the portable shade in a functional configuration.

As shown in FIGS. 1-3, an anchor unit 20 receives each end of each tent pole 14 to anchor the tent poles 14 in the deployed configuration of the portable shade 1 and the portable shade 1*a*. Each anchor unit 20 may have any design which is capable of anchoring the tent poles 14 in the deployed configuration. As shown in FIG. 4, in some embodiments each anchor unit 20 includes a generally flat or planar anchor plate 21. An anchor stake 22 extends from a lower surface of the anchor plate 21. A striker plate 25 is provided on the anchor plate 21. A pole receptacle 23 is pivotally attached to the striker plate 25 via a pivot pin 26. The pole receptacle 23 is adapted to receive an end of a tent pole 14. A lock button 24 may extend from the pole receptacle 23 to detachably engage and lock the tent pole 14 in the pole receptacle 23. In some embodiments, a support plate 27 extends from the anchor plate 21, adjacent to the pole receptacle 23. A gusset 28 may reinforce the support plate 27 on the anchor plate 21. A lock pin 29 extends through the support plate 27 and removably engages the pole receptacle 23 to secure the pole receptacle 23 in the upright, pole-supporting configuration shown in FIG. 4.

The portable shade 1 is deployed in the functional position by inserting the anchor stake 22 of each of multiple anchor units 20 in the ground (not shown) in positions which will correspond to the ends of the tent poles 14. The tent poles 14 are extended through the respective pole sleeves 12 of the canopy 2, after which the ends of the tent poles 14 are inserted and secured in the pole receptacles 23 of the respective anchor units 20. Each tie-down cord 16 is attached to each cord tab 11 (FIG. 5), after which the tie-down cord 16 is pulled taut and the stake 17 provided on each tie-down cord 16 is inserted in the ground. Therefore, the tie-down cords 16 and tent poles 14 support the canopy 2 in the functional configuration shown in FIGS. 1-3. Therefore, the portable shade 1 shades persons from the sun or other inclement weather as the persons stand or sit under the canopy 2. In the portable shade 1 shown in FIGS. 1 and 2, one or more of the windows 6 can be opened by raising and securing the window cover 8 and exposing the window screen 7 of the window 6. Each vent panel 5 in the canopy 2 facilitates ventilation of the deployed canopy 2. The portable canopy 2 is selectively disassembled typically by reversing the steps which were heretofore set forth. The canopy can be folded for space-efficient storage.

While the illustrative embodiments of the disclosure have been described above, it will be recognized and understood that various modifications can be made in the embodiments and the appended claims are intended to cover all such modifications which may fall within the spirit and scope of the disclosure.

What is claimed is:

1. A portable shade, comprising:

a canopy including a generally elongated, rectangular main canopy section having a pair of longitudinal edges and a pair of transverse edges and a pair of window canopy sections extending from said pair of longitudinal edges, respectively, of said main canopy section;

at least one window provided in each of said window canopy sections;

a plurality of generally elongated, spaced-apart pole sleeves provided on said canopy in generally parallel relationship with respect to said transverse edges of said main canopy section;

a plurality of generally elongated, curved tent poles extending through said plurality of pole sleeves, respectively;

a plurality of anchor units receiving said plurality of tent poles, respectively;

wherein each of said anchor units comprises an anchor plate, a striker plate disposed on said anchor plate and having a generally planar upper surface for striking the anchor plate to a ground, a pole receptacle pivotally carried by said striker plate and receiving a corresponding one of said tent poles, a support plate carried by said anchor plate adjacent to said pole receptacle and a lock pin extending through said support plate and detachably engaging said pole receptacle for securing the pole receptacle in an up position; and a plurality of tie-down cords extending from said canopy and a plurality of stakes provided on said plurality of tie-down cords, respectively.

2. The portable shade of claim 1 further comprising at least one vent panel provided in said main canopy section.

3. The portable shade of claim 2 wherein said at least one window comprises a window screen and a window cover selectively covering said window screen.

4. The portable shade of claim 2 further comprising at least one reinforcing strap provided on said canopy.

* * * * *